United States Patent [19]

Scheuchzer et al.

[11] 4,004,524

[45] Jan. 25, 1977

[54] METHOD OF RENEWAL OF A RAILROAD TRACK AND TRAIN THEREFOR

[75] Inventors: Fredy Scheuchzer, Lausanne; Fritz Buhler, Ecublens, both of Switzerland

[73] Assignee: Les Fils d'Auguste Scheuchzer S.A., Switzerland

[22] Filed: June 20, 1975

[21] Appl. No.: 588,711

[30] Foreign Application Priority Data

July 11, 1974 Switzerland ..... 9596/74

[52] U.S. Cl. ..... 104/2; 37/107; 104/3; 171/16

[51] Int. Cl.[2] ..... E01B 27/02; E01B 27/04; E01B 29/02; E01B 29/05

[58] Field of Search ..... 104/1 R, 2, 4, 5, 6, 104/7 R, 7 A, 3; 171/16; 37/104, 105, 106, 107

[56] References Cited

UNITED STATES PATENTS 3,685,456 8/1972 Plasser et al. ..... 104/2

3,699,894 10/1972 Plasser et al. ..... 104/2

FOREIGN PATENTS OR APPLICATIONS 549,692 5/1974 Switzerland ..... 104/2

*Primary Examiner*—Robert J. Spar
*Assistant Examiner*—Randolph A. Reese
*Attorney, Agent, or Firm*—Robert E. Burns; Emmanuel J. Lobato; Bruce L. Adams

[57] ABSTRACT

The complete renewal of a railway road track, i.e. clearing and screening the ballast, and substituting new ties and rails for the old ones, comprises a continuous sequence of operations forming repeating cycles consisting in removing the old track, clearing and screening the ballast, laying a new track with a single passage of a train comprising, in addition to the apparatus necessary for performing the operations, and to the cars necessary for transporting the rails, ties and hardware accessories, at least one track-laying and removing lift of trucks equipped with gantries and frame trucks.

9 Claims, 3 Drawing Figures

METHOD OF RENEWAL OF A RAILROAD TRACK AND TRAIN THEREFOR

BACKGROUND OF THE INVENTION

This invention relates to methods of completely renewing railroad tracks and also to a train equipped with the means necessary for carrying out this method.

The renewal of a railway road track comprises not only the substitution of new rails and ties for the old ones but also the replacement of the ballast. It is now admitted throughout the world that the clearing of old ballast and its replacement with fresh ballast is a must, for the usually dirty and clogged old ballast has lost its requisite resiliency and perviousness. On the other hand, the successive additions of gravel during tie readjustments and tamping cause the track level to be raised, and this may have serious consequences, notably along and across constructive works.

At present the ballast clearing and screening operation is currently performed before or after laying a new track. Therefore, the time necessary for performing this operation adds itself to the time required for performing the other renewal works. On the other hand, this ballast clearing and screening operation requires the lifting of the complete track by means of powerful machines, and this is likely to cause a detrimental distortion of the new rails. Since ballast clearing and screening machines are very large structures, their use is attended by time-robbing and complicated operations, notably for starting and stopping same, and up to now no really satisfactory means has been proposed for operating such huge machines between the old track clearing operation and the new track laying operation.

SUMMARY OF THE INVENTION

This important gap is filled by the present invention which provides a method for the complete renewal of a railway road track, this method being characterized in that the sequence of operations consisting in removing the old track, clearing and screening the ballast, and laying the new track, take place continuously in this order, with a single passage of the complete renewal train designed for this purpose.

This invention also comprises a train designed for the complete renewal of a railway road track, for carrying out the method set forth hereinabove, this train comprising, in addition to the cars for transporting the rails, ties and hardware accessories, at least one track-laying and removing lift of trucks equipped with gantries and open-frame wagons as already known through the U.S. patent application Ser. No. 543,863 filed Jan. 24, 1975, said train being characterized in that said lift of trucks further comprises the means necessary for clearing the ballast and conveying same to a screener equipping a truck located outside the renewal section or area.

The method of this invention, which comprises the ballast clearing and screening operation performed during a single and same passage of the trains for the complete renewal of the rail road track is extremely advantageous in that it not only simplifies the renewal process but affords a considerable time saving.

DESCRIPTION OF THE PREFERRED EMBODIMENTS

Figures 1, 2, 3:
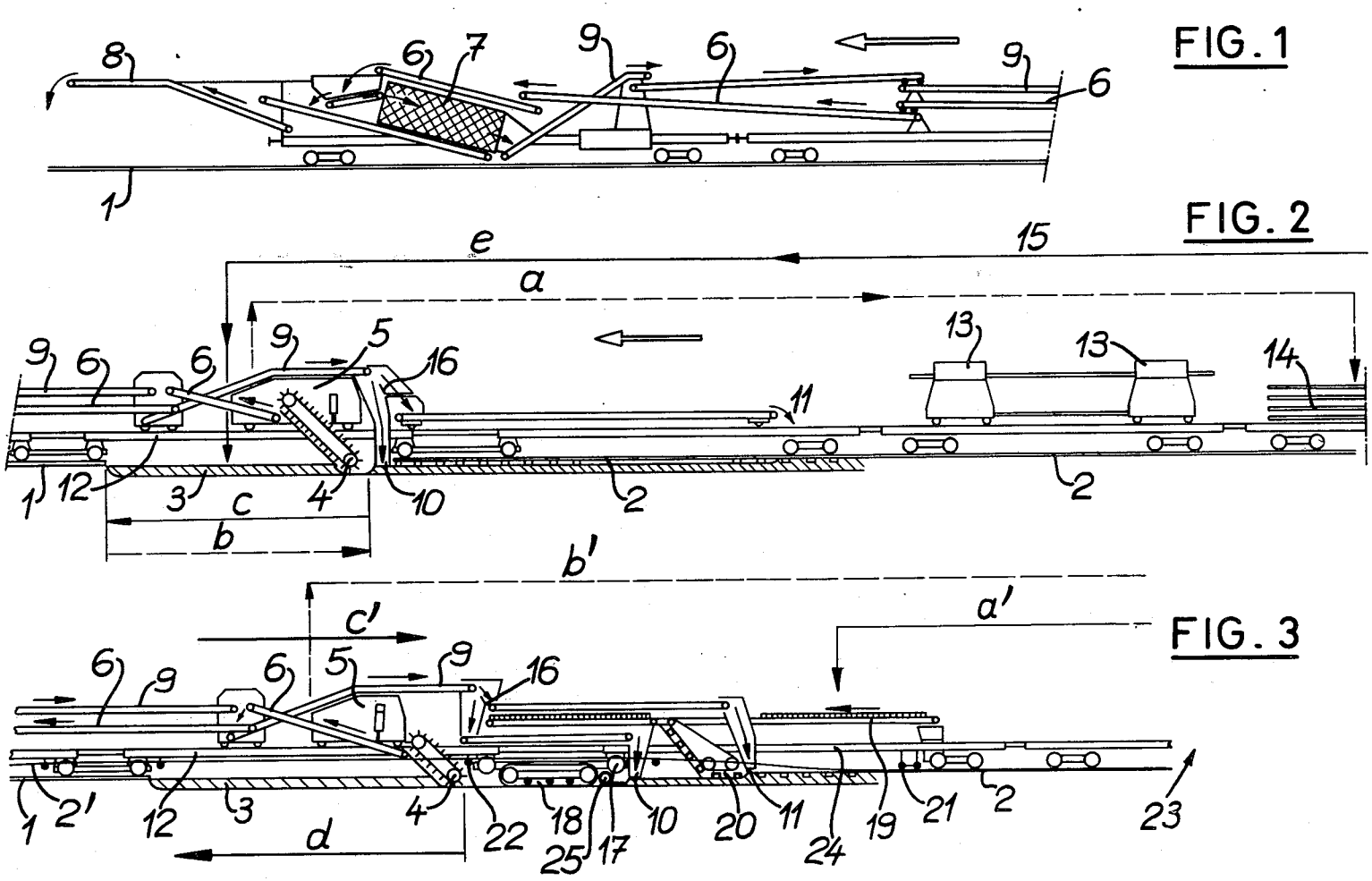
FIGS. 1 and 2 illustrate diagrammatically by way of example the mode of operation of a train for the complete renewal of a track according to the method of this invention, the ballast clearing and screening operation being performed while the train is at a standstill.
FIG. 3 is a similar view showing a modified form of embodiment of the train, the ballast clearing and screening operation taking place while the train is moving forward.

FIGS. 1 and 2 are to be seen as forming the extension of each other, with the right-hand end of FIG. 1 continued by the left-hand end of FIG. 2. The assembly illustrates diagrammatically a track renewal train of which the front end rolls on the old track 1 and the rear end rolls on the new renewed track 2. The intermediate section 3 illustrates the trackless bed, and the reference numeral 4 designates the ballast clearing machine supported by its gantry 5. During its operation, the machine 4 progresses above the bed portion 3 to be cleared. In order to maintain at a constant value the depth of the ballast bed to be cleared, the rear bearing portion of frame truck 12 may be adjusted vertically in relation to the freshly laid track either by manual control means or by servo-action hydraulic means (not shown). The reference numeral 6 designates the series of conveyors, for example of the endless belt type, conveying the ballast to the screener 7. At the front end of the train, means 8 are provided for discharging the rubbish from the screener into an empty hopper car (not shown) disposed either ahead or laterally at a lower level, while the reusable ballast is returned via conveyors 9 for filling the track bed at 10 and 11. The reference numeral 16 designates a flap door for metering the amount of ballast to be deposited onto the track bed 10, before laying the new ties, according to the desired track level, the residue being deposited at 11 between the ties and at the tie ends. At 12 there is shown diagrammatically a frame car through which the track panels (i.e. a unitary rail and tie assembly) are removed by means of gantries 13, loaded on a car 14, said gantries picking up the new rails from a car (not shown).

The railroad track renewal train illustrated in FIGS. 1 and 2 operates as follows:

Assuming that the train is stopped, a track panel is removed by means of gantries 13 through a frame car 12 and transferred by said gantries to a car 14 along the path *a*.

The ballast clearing means previously stored at the front end to clear the passage for removing the rails are brought to their operative position in the direction of the arrow *b*.

While the train is kept at a standstill, the clearing members, consisting for example of excavators, travel in the direction of the arrow C; these clearing members are carried by other gantries 5 rolling on the lift of trucks and are adapted to clear the track bed along the section 3 from which the rails have already been removed. At the same time, conveyors 6 deliver the ballast to the screener 7 from which other conveyors 8 discharge the rubbish into a hopper truck provided to this end while conveyors 9 return the reusable ballast in order to spread it over the freshly laid new track panel from 10 to 11.

Then, the ballast clearing members are retracted or stowed at the front, outside the operating area of the gantries, and the gantries 13 are operated along path *e* for laying a previously assembled track panel brought from a rear truck (not shown) by the same gantries 13.

Finally, the train is moved forward through a distance corresponding to a track panel and the cycle described hereinabove is resumed, and so forth.

A modified construction of this train, particularly adapted for laying long rails (e.g. 36 m or longer rails) is illustrated in FIG. 3. The rail laying and removing unit comprises two successive frames 12 and 24 both pivoted to an intermediate bogie truck of which the wheels 17 used only for light running are retractable and replaced during the operation by a tracklaying frame 18. The length of frame 12 is adequate for removing track panel and the length of frame 24 is sufficient for bringing the long rails 2', located outside the track, to the normal gage by means of rollers 22 and roller-type clamps 21. In contrast to the first embodiment shown in FIGS. 1 and 2, the ballast clearing unit 4 does not travel along the lift of trucks and remains stationary in relation to the lift; the latter travels bodily with the complete train throughout the ballast clearing operation. The clearing unit is mounted for vertical adjustment on the intermediate bogie truck, whereby the clearing depth remains constant in relation to the old track bed. This depth may be adjusted either manually or through servo-action hydraulic means (not shown) from the front bogie truck of the rail laying lift of trucks. According to the type of ground on which the train is operating, an impervious layer 25 suspended in the form of rolls beneath the intermediate bogie truck (FIG. 3) is laid upon the cleared bed surface before spreading the clean ballast at 10, the layer 25 being unrolled as the train progresses along the track. Reference numeral 19 designates the conveyor delivering the new ties, and 20 designates the device for laying the ties one by one; finally, a tie screwing truck (not shown) may be provided at 23.

The modified structure illustrated in FIG. 3 operates as follows: The train is stopped and the number of ties corresponding to a track panel is brought along the path *a'* by the conveyor 19 to the laying device 20. Then, a previously laid track panel is removed from area 3 through the frame truck 12 along the path *b'*, by using the gantries 13 (not shown in this Figure), whereafter the conveyors 6 for discharging the ballast to the screener, and conveyors 9 returning the screened, clean ballast to the new track section, are brought back to their operative position by means of gantry 5 along path *c'*.

The complete train is subsequently moved forward through a distance corresponding to one track panel, i.e. along the path *d*, and during this travel the ballast clearing and screening operation, followed by the laying of ties one by one by means of the device 20 provided for this purpose, and eventually the laying of long rails by means of the set of roller-type clamps 21, are accomplished. The cycle is ended by stopping the train and returning the conveyors 6 and 9 to the front of the lift of trucks.

Of course, other modified embodiments of the track renewal train may be contemplated by those conversant with the art without departing from the basic principle and method of this invention. Thus, the method described hereinabove with reference to FIGS. 1 and 2 may be modified in that instead of laying previously mounted track panels only the ties are laid along the path *e* with the assistance of gantries 13 equipped with a tie laying beam. Then, the long rails, preferably disposed along the track, are positioned by means of roller-type clamps 21 as shown in FIG. 3 during the forward travel of the train. To this end, the renewal train illustrated in FIGS. 1 and 2 comprises an intermediate caterpillar bogie truck 18 as illustrated in FIG. 3.

Furthermore, other tools and equipment than those described hereinabove and illustrated diagrammatically in the attached drawing may be contemplated; hence, the intermediate bogie truck illustrated in FIG. 3 may be provided with drive and steering means or the like, the ballast clearing and screening means may comprise a power shovel, and the ballast itself, instead of being transported by endless belt conveyors, may be supplied by means of buckets travelling on the gantry runways.

What is claimed is:

1. Method of complete renewal of a railway track wherein the operating cycle comprises the following steps:

a. removing along a first path by means of gantries carried by a train a track panel of an old railway track to be renewed while said train is stopped;
b. bringing ballast-clearing members on said train to an operating position along a second path;
c. while keeping the train at a standstill, moving the clearing members forward and clearing the ballast from a bed of the removed track panel, conveying the removed ballast to a screener, discharging the rubbish from said screener by means of other conveyors, and respreading the clean ballast on the track bed on at least two locations simultaneously;
d. moving the clearing members outside the working area of the gantries;
e. laying a previously assembled track panel along a third path on the respread clean ballast;
f. moving the train forward; and
g. resuming the cycle.

2. Method of complete renewal of an old track comprising the following steps:

a. removing a track section of an old railway track to be renewed by means of gantries carried by a train;
b. bringing ballast clearing members on said train to their operative position;
c. while the train is at a standstill, causing said ballast clearing members to move forward and clear the track bed length corresponding to the removed track section, conveying the removed ballast to the screener, discharging the rubbish from said ballast and re-spreading the clean ballast on the track bed at at least two locations simultaneously;
d. moving the ballast clearing members outside the working areas of the gantries;
e. laying the ties on the respread clean ballast;
f. moving the train forward while laying long rails on said ties by means of roller-type clamps; and
g. resuming the cycle of operations.

3. A method of renewing a railway track and its bed comprising:

a. removing a track panel as a unit from an old railway track bed;
b. removing ballast from a trackless bed section of the railway track bed from which said track panel was removed;
c. screening the removed ballast to remove therefrom rubbish and clean it;
d. returning at least part of the cleaned ballast to the trackless bed section to raise it to a desired level;

e. while screening said ballast laying at least ties on said trackless bed section to raise it to a predetermined level; and f. while returning said cleaned ballast continuously metering it to control the amount of cleaned ballast returned to said bed as a function of said predetermined level to which said bed is to be raised, and diverting said at least part of the cleaned ballast to said bed and simultaneously transporting the remainder of the metered cleaned ballast and discharging it between said ties.

4. Apparatus for renewing an old railway track and the bed therefor comprising, a train assembly having:

a. cars for transporting rails, ties and necessary hardware for renewing an old railway track and the bed thereof;

b. at least one track and rail laying lift truck means having gantries;

c. a ballast clearing means for removing ballast of a trackless bed section from which track and ties have been removed and while said train assembly is at a standstill;

d. a screener remote from the trackless bed section for screening the removed ballast to clean it;

e. means for transporting the removed ballast from said clearing means to said screener;

f. means including means for transporting cleaned ballast from said screener and respreading on said trackless bed section for rebuilding it to a desired level including metering means for automatically controlling the volume of cleaned ballast returned to said trackless bed section; and g. means coactive with said metering means for transporting the remainder of the metered cleaned ballast and delivering it between ties laid on said trackless bed section simultaneously with return of cleaned ballast to said trackless bed section.

5. Apparatus according to claim 4, in which said train assembly includes means to remove track panels as individual units.

6. Apparatus according to claim 4, in which said track and rail laying lift truck means comprises means for laying rails and ties constructed as unitary panels over the cleaned ballast.

7. Apparatus according to claim 4, in which said track and rail laying lift truck means comprises means to remove track panels comprising rails and ties as a unit and for laying pre-constructed track panels on said trackless bed section.

8. Apparatus according to claim 4, in which said track and rail laying lift truck means comprises a bogie disposed intermediate opposite ends of the train assembly and having a length sufficient for laying long rails.

9. Apparatus according to claim 4, in which said track and rail laying lift truck means comprises means for controlling the depth to which said ballast is removed.

* * * * *